United States Patent [19]

Burton, III et al.

[11] 4,249,602

[45] Feb. 10, 1981

[54] METHOD OF DOPING RETORT WITH A HALOGEN SOURCE TO DETERMINE THE LOCUS OF A PROCESSING ZONE

[75] Inventors: Robert S. Burton, III; Carlon C. Chambers, both of Grand Junction, Colo.

[73] Assignee: Occidental Oil Shale, Inc., Grand Junction, Colo.

[21] Appl. No.: 942,680

[22] Filed: Sep. 15, 1978

[51] Int. Cl.[2] ..... E21B 43/24; E21B 47/10

[52] U.S. Cl. ..... 166/251; 166/259; 166/272; 299/2

[58] Field of Search ..... 166/250, 251, 252, 256, 166/259; 299/2

[56] References Cited

U.S. PATENT DOCUMENTS

| | | | |
|---|---|---|---|
| 2,658,724 | 11/1953 | Arps | 175/41 |
| 3,011,566 | 12/1961 | Graham | 175/39 |
| 3,044,543 | 7/1962 | Ramey, Jr. | 166/251 |
| 3,072,184 | 1/1963 | Parker | 166/251 |
| 3,174,543 | 3/1965 | Sharp | 166/251 X |
| 3,678,883 | 7/1972 | Fischer | 175/39 X |
| 4,082,145 | 4/1978 | Elkington | 166/251 |
| 4,118,071 | 10/1978 | Hutchins | 166/259 X |
| 4,120,354 | 10/1978 | Ridley et al. | 166/251 |

*Primary Examiner*—Stephen J. Novosad
*Assistant Examiner*—George A. Suchfield
*Attorney, Agent, or Firm*—Christie, Parker & Hale

[57] ABSTRACT

The locus of a processing zone advancing through a fragmented permeable mass of formation particles in an in situ oil shale retort in a subterranean formation containing oil shale and which generates an effluent fluid is determined by placing a halogen source in the permeable mass for providing an identifiable halogen and monitoring effluent fluid from the processing zone for presence of such halocarbon. The halogen source provides halogen at a predetermined temperature.

31 Claims, 6 Drawing Figures

METHOD OF DOPING RETORT WITH A HALOGEN SOURCE TO DETERMINE THE LOCUS OF A PROCESSING ZONE

CROSS-REFERENCES

This application is related to U.S. patent applications: Ser. No. 801,631, filed on May 31, 1977, by Robert S. Burton III and Carl Chambers, now U.S. Pat. No. 4,149,592 entitled CONTAINERS FOR INDICATORS; Ser. No. 798,376, filed on May 9, 1977, by Robert S. Burton III, entitled USE OF CONTAINERS FOR DOPANTS TO DETERMINE THE LOCUS OF A PROCESSING ZONE IN A RETORT and now abandoned; and Ser. No. 869,668, filed Jan. 16, 1978, by Robert S. Burton III, now U.S. Pat. No. 4,148,529 entitled DOPING A RETROT TO DETERMINE THE LOCUS OF A PROCESSING ZONE; and all assigned to the assigneee of this invention. These applications are incorporated herein by this reference.

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposits having layers containing an organic polymer called "kerogen," which upon heating decomposes to produce hydrocarbon liquid and gaseous products. It is the formation containing kerogen that is called "oil shale" herein, and the liquid hydrocarbon product is called "shale oil."

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination, surface distortion, and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as a gaseous combustion zone feed to advance the combustion zone through the retort. In the combustion zone, oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100 F. to avoid plugging of the retort, and above about 1100 F for efficient recovery of hydrocarbon products from the oil shale.

The effluent gas from the combustion zone comprises combustion gas and any gaseous portion of the combustion zone feed that does not take part in the combustion process. This effluent gas is essentially free of free oxygen and contains constituents such as oxides of carbon and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of the combustion zone feed that does not take part in the combustion process are also withdrawn to the surface.

It is desirable to know the locus of parts of the combustion and retorting processing zones as they advance through an in situ oil shale retort for many reasons. One reason is that by knowing the locus of such a processing zone, steps can be taken to control the orientation of the advancing side of the processing zone. It is desirable to maintain a processing zone which is flat and uniformly transverse and preferably uniformly normal to the direction of its advancement. If the combustion zone is skewed relative to its direction of advancement, there is more tendency for oxygen present in the combustion zone to enter the retorting zone and burn shale oil or combustible gases, thereby reducing hydrocarbon yield. In addition, with a skewed processing zone, more cracking of the hydrocarbon products can result. Monitoring the locus of parts of the processing zone provides information for control of the advancement of the processing zone to maintain it flat and uniformly perpendicular to the direction of its advancement to obtain high yield of hydrocarbon products.

Another reason for which it can be desirable to monitor the locus of the processing zone is to provide information so the composition of the combustion zone feed mixture can be varied with variations in the kerogen content of oil shale being retorted. Formation containing oil shale includes horizontal strata or beds of varying kerogen content, including strata containing substantially no kerogen, and strata having a relatively high kerogen content such as having a Fischer assay of 80 gallons per ton. If combustion zone feed containing too high a concentration of oxygen is introduced into a region of a retort containing oil shale having a high kerogen content, oxidation of carbonaceous material in the oil shale can generate sufficient heat that fusion of the oil shale can result, thereby producing a region of the fragmented mass which cannot be penetrated by processing gases. High temperatures also can cause excessive endothermic carbonate decomposition to carbon dioxide and dilution of the off gas from the retort, thereby lowering the heating value of the off gas. Layers in the fragmented mass inherently correlate with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted thereon to determine the kerogen content. Such samples can be taken from the fragmented mass, from formation before expansion, or from formation nearby the fragmented mass since little change in kerogen content of oil shale occurs over large areas of formation. Then, by monitoring the locus of the combustion zone as it advances through the retort, the composition of the combustion zone feed can be appropriately modified.

Another reason for monitoring the locus of the combustion and retorting processing zones as they advance through the retort is to monitor the performance of the retort to determine if sufficient shale oil is being produced in relation to the amount of oil shale being retorted.

Further, by monitoring the locus of the combustion and retorting processing zones, it is possible to control the advancement of these two zones through the retort at an optimum rate. The rate of advancement of the combustion and retorting processing zones through the retort can be controlled by varying the flow rate and composition of the combustion zone feed. Knowledge of the locus of the combustion and retorting processing zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

BRIEF SUMMARY OF THE INVENTION

The present invention concerns a method for determining the locus of a processing zone, such as a combustion zone and a retorting zone, advancing through a fragmented permeablle mass of formation particles in an in situ oil shale retort in a subterranean formation containing oil shale, wherein an effluent fluid is produced during processing. The method comprises the steps of placing at a selected location in the formation within the boundaries of an in situ oil shale retort to be formed in the formation, a halogen source for providing a halogen at a predetermined temperature greater than ambient. Then, formation within the boundaries of the in situ oil shale retort to be formed is explosively expanded forming an in situ oil shale retort containing a fragmented permeable mass of formation particles containing oil shale, and containing the halogen source. The processing zone is advanced through the fragmented mass for forming at least one effluent fluid and for providing halogen from the halogen source. Such an effluent fluid from the retort is monitored for presence of halogen to determine the locus of the processing zone.

The temperature at which the halogen is provided by the halogen source depends upon the locus of which processing zone is being determined. For example, if the processing zone is the retorting zone, the halogen can be provided at a temperature characteristic of the temperature of the retorting zone. If the processing zone is a combustion zone, the halogen can be provided at a temperature characteristic of the temperature of the combustion zone.

A plurality of halogen sources can be provided at a plurality of selected locations spaced apart from each other for monitoring the locus of a processing zone. Such halogen sources can be spaced apart from each other along the direction of advancement of the processing zone for monitoring the locus of the processing zone as it advances through the fragmented mass. In addition, such halogen sources can be spaced apart from each other in a plane substantially perpendicular or normal to the direction of advancement of the processing zone for determining if the processing zone is skewed and/or warped.

When using a plurality of such halogen sources, halogen sources which provide different halogens can be used to ascertain the configuration and locus of the processing zone. Also, by using halogen sources for providing a first halogen at a temperature characteristic of the combustion zone, and a second different halogen at a temperature characteristic of the retorting zone, the locus of both the combustion and retorting processing zones can be determined.

DRAWINGS

These and other features, aspects and advantages of the present invention will become more apparent upon consideration of the following description, appended claims, and accompanying drawings wherein:

FIG. 1 represents in horizontal cross section an in situ oil shale retort having halogen sources;

FIG. 2, which is taken on line 2-2 in FIG. 1, schematically represents in vertical cross section the in situ oil shale retort of FIG. 1;

DETAILED DESCRIPTION OF THE INVENTION

Figure 2:
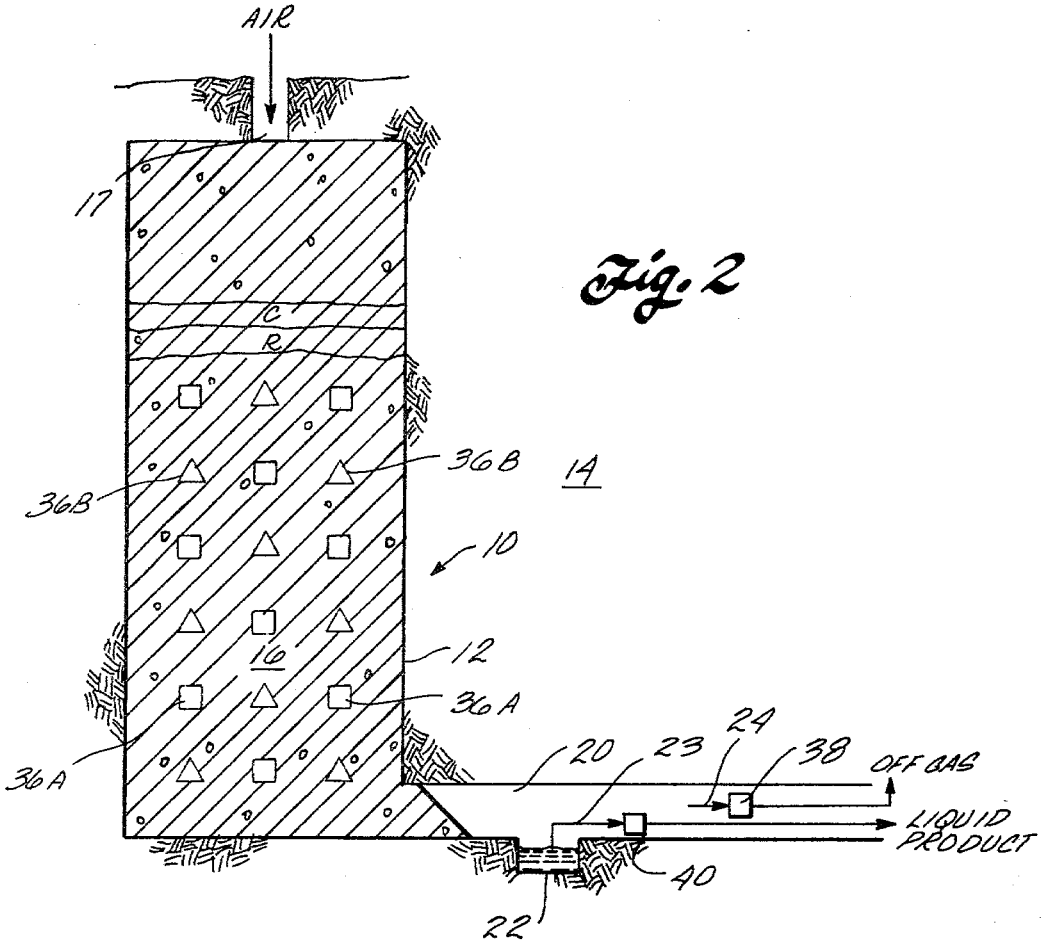
Figure 1:
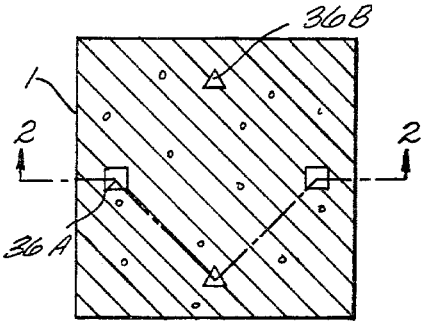

Referring to FIGS. 1 and 2, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with the fragmentation forming the mass 16 of formation particles by blasting utilizing any of a variety of techniques. A desirable technique involves excavating or mining a void within the boundaries of an in situ oil shale retort site to be formed in the subterranean formation and explosively expanding remaining oil shale in the formation toward such a void. A method of forming an in situ oil shale retort is described in U.S. Pat. No. 3,661,423. A variety of other techniques can also be used.

A conduit 17 communicates with the top of the fragmented mass 16 of formation particles. During the retorting operation of the retort 10, a combustion processing zone C is established in the retort and advanced by introducing an oxygen containing retort inlet mixture, such as air or air mixed with other fluids, into the in situ oil shale retort through the conduit 17 as a combustion zone feed. The combustion processing zone is that portion of the retort wherein the greater part of the oxygen in the combustion zone feed that reacts with residual carbonaceous material in retorted oil shale is consumed. Oxygen introduced to the retort in the combustion zone feed oxidizes carbonaceous material in the oil shale to produce combustion gas. Heat from the exothermic oxidation reactions, carried by flowing gases, advances the combustion zone through the fragmented mass of formation particles.

Combustion gas produced in the combustion zone and any unreacted portion of the combustion zone feed pass through the fragmented mass of formation particles on the advancing side of the combustion zone to establish a retorting processing zone R on such advancing side of the combustion zone. Kerogen in the oil shale is retorted in the retorting zone to produce liquid and gaseous products.

There is an access tunnel, adit, drift, or the like 20 in communication with the bottom of the retort. The drift contains a sump 22 in which liquid products 23, including water and liquid hydrocarbon products (shale oil), are collected to be withdrawn. An off gas 24 containing gaseous products, combustion gas, carbon dioxide from carbonate decomposition, and any unreacted gaseous portion of the combustion zone feed is also withdrawn from the in situ oil shale retort 10 by way of the drift 20. The liquid products and off gas are withdrawn from the retort as effluent fluids.

Retorting of oil shale can be conducted with combustion zone temperatures as low as about 800° F. However, for economically efficient retorting, it is preferred to maintain the combustion zone at least at about 1100° F. The upper limit for the temperature in the combustion zone is determined by the fusion temperature of oil shale, which is about 2100° F. The temperature in the combustion zone preferably is maintained below about 1800° F. to provide a margin of safety between the temperature in the combustion zone and the fusion temperature of the oil shale.

Placed at selected locations in the fragmented permeable mass 16 of formation particles in the retort 10 are halogen sources 36A and 36B. Each halogen source provides a halogen at a predetermined temperature greater than ambient and less than the maximum temperature in the retort, i.e., less than about 2100° F. The halogen sources can be spaced equidistant from each other or at any selected spacing. The halogen sources for providing halocarbon are referred to herein as "halogen sources," "doping material," and "dope."

The term "halogen source" as used herein can be a halogen-containing chemical substance or an apparatus for providing a halogen, a halocarbon and/or any other halogen-containing chemical substance. The term "halogen" as used herein refers generically to the halogens, such as fluorine, chlorine, bromine, iodine and astatine and is also used herein in a larger generic sense to refer to other chemical compounds containing halogens such as halocarbons, halosilanes, hydrogen halides and the like.

Suitable apparatus includes a container-confining halocarbon where the container releases halogen at a predetermined temperature greater than ambient and less than the maximum temperature in the retort. Use of a container as a halogen source is described herein and in the aforementioned United States Patent Applications, Ser. No. 801,631, now U.S. Pat. No. 4,149,592, and Ser. No. 798,376.

Halogen detection instruments as monitoring means can be provided for monitoring an effluent fluid from the retort for presence of halogen or material containing or derived from halogen, such as halocarbons $Cl_2$, HCl and the like. A suitable halogen detection instrument as a monitoring means is a gas chromatograph. As used herein, when reference is made to monitoring a measurable material in the off gas or liquid, such reference is generally made to monitoring the halogen material present. However, this use of halogen material for monitoring purposes includes halogens, halocarbons, halosilanes and products derived from halogens such as HCl and the like. For example, monitoring means 38 can be provided for monitoring the off gas 24 for presence of halogen material. Similarly, monitoring means 40 can be provided for monitoring the liquid products 23 for presence of halogen material. The water and/or liquid hydrocarbons withdrawn from the retort can be monitored.

When a container is used and a halogen is placed in the container as a halogen source, material released by the container is not necessarily the same as the halogen initially placed in the container. For example, the material released by the container can be a thermal decomposition product of a halogen material originally placed in the container. Furthermore, halogen material, for which monitoring is conducted, is not necessarily the same material released by the container. The halogen material monitored and present in effluent gas or liquid from a retort can be a halogen source such as released from a halogen container, a reaction product of a reaction in which a halogen source is a reactant, a reaction product in which the reactants are the halogen source, a thermal decomposition product of a halogen source, and the like. For example, when a container confining a halocarbon such as trichlorotrifluoroethane is the halogen source, effluent gas from the retort can be monitored for $C_2F_3Cl_3$, thermal decomposition products of $C_2F_3Cl_3$ such as fluorine and chlorine, or reaction products of $C_2F_3Cl_3$ such as $CF_3H$, HCl, $C_2H_5Cl$, $CF_4$, $C_2F_5H$, $COF_2$, $CF_3Cl$, $CF_2Cl_2$, $C_2F_4H_2$, $C_2F_6$, $CF_2H_2$, $C_2F_4Cl_2$, and the like.

As an additional example, when a halocarbon such as polychlorotrifluoroethylene is the halogen source, effluent liquid from the retort can be monitored for the melted polymer, and/or effluent liquid from the retort can be monitored for thermal decomposition products of the polymer. In addition, off gas from the retort can be monitored for thermal decomposition products of the polymer such as fluorine, chlorine, HF, and HCl, and/or off gas can be monitored for reaction products of the polymer, such as $COF_2$, COFCl, $CF_3H$, and $CHF_2CFCl$.

The changes a halogen source can undergo are exemplified by use of a container confining cesium dibromochloride. Both the container and the cesium dibromochloride are halogen sources as the term is defined herein. At 150° C. cesium dibromochloride releases bromine gas. Thus, cesium dibromochloride can be placed in a container as a halogen source. The bromine gas released from the container can react with methane in off gas to yield methyl bromide. Off gas from the retort can be monitored for the methyl bromide. Thus, cesium dibromochloride and the container containing the cesium dibromochloride are halogen sources which provide bromine, which in turn is another halogen source. The bromine reacts with methane forming methyl bromide which is a halogen material which can be detected in the off gas.

The halogen source selected for use in this method is one which provides a halogen material which normally is not present in the effluent fluids from the retort, or is present prior to activation of the halogen source at a known non-varying standard concentration or at a concentration less than the concentration resulting from provision of the halogen material by the halogen source. Sufficient halogen source needs to be provided in the fragmented mass that a concentration of halogen material which is detectable in an effluent fluid is provided. For halogen material detectable in off gas, preferably the off gas has a background concentration of such halogen material of no more than about 20 parts per million by volume so the presence of such halogen material in the off gas is not masked by the background concentration.

Halogen sources can be selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons; halosilanes; hydrogen halides; molecular halogens; and mixtures thereof. Exemplary halocarbons which can provide halogen material for detection in the off gas include suitable halocarbons such as the halocarbons sold by DuPont under the trademark Freon, such as, Freon 11 ($CCl_3F$), Freon 12 ($CCl_2F_2$), Freon 13 ($CClF_3$), Freon 113 ($CCl_2FCClF_2$), Freon 116 ($C_2F_6$), and the like. Advantages of using Freon gases as halogen sources include low cost, thermal stability, nontoxicity, availability, chemical stability, and absence of these gases in normal retort off gas. These gases also exhibit very low detection limits, i.e., less than 100 parts per million by volume by several analytical methods including mass spectrometry. Other detection methods which can be used for Freon gases include gas chromotography with electron capture detectors and infrared spectroscopy.

An advantage of use of halocarbons is that they are available in a variety of fluorine to chlorine ratios and are also available with bromine. Therefore, different portions of the retort can be doped with different halocarbons, and by determining the fluorine to chlorine ratio in the off gas, the region from which the halocarbon has been released can be determined for accurate determination of the locus of a processing zone advancing through the retort. By using halocarbons containing bromine, an even larger variety of halocarbons for accurate determination of the locus of a processing zone can be effected.

Another advantage of using mixtures of halocarbons in a halogen source is that the measurable halogen material provided thereby can be ratios of the separate halogens to carbon expressed as values other than integral values of the compounds. Therefore, by varying the concentrations of the various halogens in different halogen sources, halogen material detected in the effluent has different apparent molecular ratios. In this manner, a wide variety of varying halogens and mixtures of halogens with varying concentrations can be used for establishing the locus of processing zones. The effluent from the retort is monitored and the halogen ratio of one halogen material to another halogen material is determined. After determining the ratio of the halogen materials, the locus of a processing zone within the retort can be determined based upon the positioning of the known concentrations of halogen in the halogen sources at various locations in the retort.

Several halogen sources which provide halogen material at different temperatures can be used. For example, a first halogen source 36A can provide halogen at a temperature characteristic of the combustion processing zone. A second halogen source 36B can provide halogen at a temperature characteristic of the retorting processing zone. Thus, as the combustion processing zone reaches a first halogen source 36A, halogen is provided, and as the retorting processing zone reaches a second halogen source 36B, halogen is provided. Preferably, the halogen provided by the first and second halogen sources 36A and 36B respectively, are different from each other so the locus of both the retorting and combustion processing zones can be determined.

Preferably, a plurality of halogen sources are placed in the retort spaced apart from each other along the direction of advancement of a processing zone through the fragmented mass so the locus of the processing zone can be determined at various times as the processing zone advances. When the combustion and retorting zones are advancing downwardly or upwardly through the retort, such halogen sources can be vertically spaced apart from each other.

As exemplified in FIG. 2, a plurality of first halogen sources 36A can be located vertically spaced apart within the retort. Preferably, the first halogen sources 36A at the different elevations within the retort provide different halogens from each other and the second halogen sources 36B at the different elevations within the retort provide different halogens from each other. In this manner, the advancement of the locus of both the retorting and the combustion processing zones can be monitored. Similarly, if the processing zones advance transverse to the vertical, the halogen sources 36A located in a vertical plane can provide a different halogen than the halogen sources 36A located in a different vertical plane. It is sufficient for determining whether a processing zone is warped or skewed if the first halogen sources 36A in adjacent planes provide different halogen material. In this manner the same first halogen source can be used in nonadjacent planes normal to the advancement of the processing zone. As with the first halogen sources 36A the second halogen sources 36B can also be varied such that the halogen sources 36B located in different places within the retort provide different halogens from each other or, preferably, at least different halogens from each other in adjacent planes normal to the direction of advancement of the processing zone.

It is most preferred that any halogen source provides a different detectable halogen material than any other halogen source which is adjacent to it. In this manner of arrangement of halogen sources, the configuration of the processing zone advancing through the retort can best be monitored. For example, if a processing zone is skewed or warped by having all adjacent halogen sources providing different halogen materials, the location of the warp can be determined.

Preferably, at least two halogen sources for a processing zone are placed in the retort in a plane substantially normal to the direction of advancement of the processing zone through the fragmented mass. For example, when a processing zone is advancing downwardly or upwardly through the fragmented mass, two or more halogen sources are laterally spaced apart from each other at the same elevation in the retort. This permits determination of whether a processing zone advancing through the fragmented permeable mass is flat and uniformly transverse to its direction of advancement, or if the processing zone is skewed and/or warped. When the monitoring means detects a quantity or type of halogen material commensurate with release of halogen by the two or more halogen sources in the plane, there is an indication that the processing zone is uniformly transverse to its direction of advancement.

It is most preferred that at least three halogen sources be provided in the retort in a plane substantially normal to the direction of advancement of a processing zone through the fragmented mass. At least three halogen sources are most preferred because, as a matter of geometry, it takes three points to define a plane. Use of only two halogen sources does not provide sufficient information to determine whether a processing zone is skewed unless the direction of skewing happens to coincide with the positions of the sources.

Halogen sources spaced apart from each other along the direction of advancement of a processing zone and halogen sources spaced apart from each other in a plane normal to the direction of advancement of a processing zone, can be used in combination for determining if a processing zone is skewed and/or warped throughout the retorting process.

Preferably, a halogen source which provides halogen material detectable in the off gas is used. This requires that at least a portion of the halogen material is in the vapor phase at the temperature and pressure of the off gas. An advantage of using a halogen material detectable in the off gas is that the composition of the off gas is more quickly responsive to changes in the retorting process than is the composition of the liquid product stream 23. This is because liquid products tend to "hang up" in the retort; that is, flow is retarded by contact between the liquids and the fragmented mass. For example, delays of as much as a week between initiation of retorting and collection of liquid products in the sump 22 can occur. When a halogen material detectable only in the water and/or hydrocarbon products is used, a lag time of as much as a week can occur between movement of the processing zone through a region in which a container-confining halogen source is located and detection of halogen material in the effluent liquid from the retort. On the other hand, gases can pass downwardly through a retort at about five feet per minute and faster.

The halogen sources can be placed at selected locations within the boundaries of a retort to be formed in the subterranean formation 14 by drilling boreholes downwardly from the ground surface or from a subterranean working level or base of operation above the retort to be formed, by drilling boreholes upwardly from a production level below the retort to be formed, and/or by drilling boreholes from a work level between the top and bottom of the retort to be formed. Then halogen sources such as containers are placed into such boreholes within the boundaries of the retort to be formed.

When placing halogen sources within the retort boundaries from above the retort, the halogen sources can be lowered into the boreholes, preferably suspended from a measuring rope for accurate determination of the elevation in the retort where a halogen source is placed. Stemming, which is an inert material typically used in shotholes between adjacent charges and between an explosive charge and the outer end of a shot hole, can be used between halogen sources in the boreholes. The stemming can be sand, gravel, or crushed oil shale.

Preferably, for ease of placement, the halogen sources are placed in unfragmented formation in the retort site prior to blasting to form the cavity 12 and the fragmented mass 16.

Figure 5:
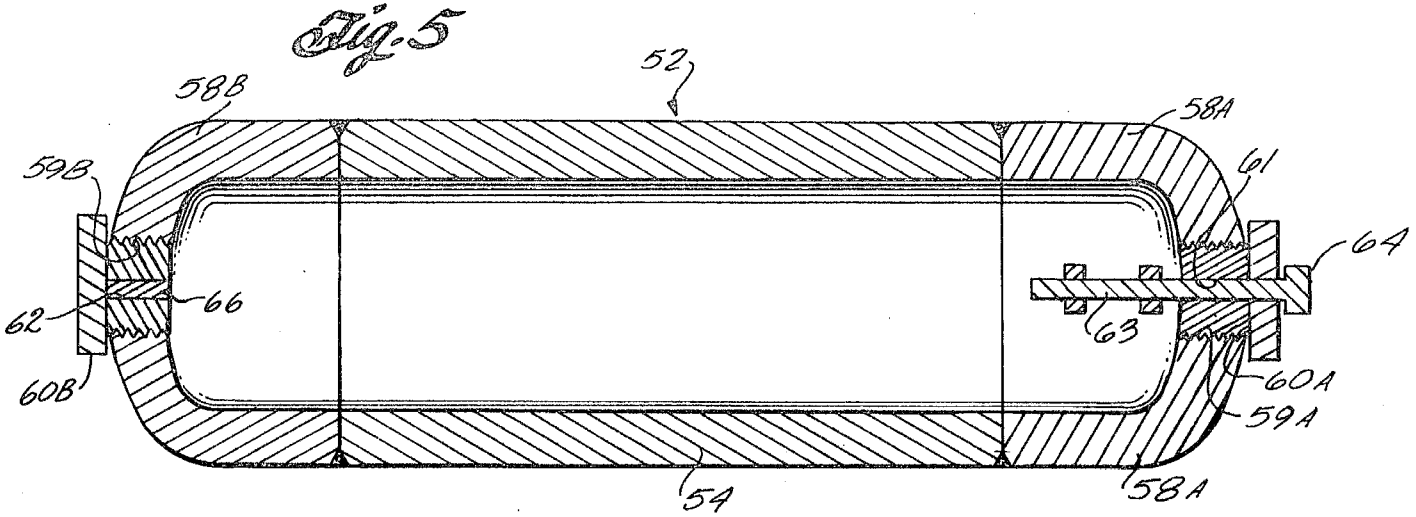
FIG. 5 shows in partial cross section a container for confining a halogen source for use with the retorts of FIGS. 3 and 4.

Container means 52 useful for confining a fluid halogen source and releasing the halogen source at a selected temperature is shown in FIG. 5 and more fully described in patent application Ser. Nos. 801,631 and 798,376. The container 52, which is particularly useful for a gaseous halogen source, is referred to herein as a "gas bomb." Such a gas bomb can also be used for confining a liquid or solid halogen source. The container 52 comprises a cylindrical pipe 54 capped at both ends with welded on caps 58A and 58B.

A filling mechanism is provided with a threaded plug 60A in a threaded hole 59A in one of the end caps 58A, and a discharging mechanism is provided with a threaded plug 60B in a threaded hole 59B in the other end cap 58B.

A fill hole 61 is provided through one of the plugs 60A, and a release hole 62 is provided through the other plug 60B. The fill hole 61, which is threaded, holds a check valve 63 having an elastomeric seal. The container is filled through the check valve which prevents premature release of halogen source. Since the elastomeric seal of the check valve 63 can degrade at the high temperatures of retorting, the exterior end of the fill hole 61 is closed with a plug 64 to prevent premature release of the contents of the container 52. The release hole 62 contains means for preventing release of the halogen source at a temperature less than the preselected temperature and for releasing the halogen source at the preselected temperature. A fusible cast plug 66 is provided in the release hole 62 for release of the halogen source.

The material for the fusible plug is one which fuses at the temperature at which it is desired to release the halogen source. Zinc, which melts at about 787° F., can be used. It is believed that in practice the zinc plug melts at a temperature characteristic of the retorting zone.

Other materials which can be used for the plug include aluminum, aluminum alloys, lead, silver, brass, bronze, and magnesium alloys. For example, naval brass, which melts at 1625° F., can be used to release a halogen source at a temperature corresponding to the combustion zone. By providing a first set of containers having naval brass plugs and confining a first type of halogen source and a second set of containers having zinc plugs and confining a second type of halogen source, where the halogen source provided by the first and second types of halogen sources are different from each other, the locus of both the retorting and combustion processing zones can be determined.

Figure 6:
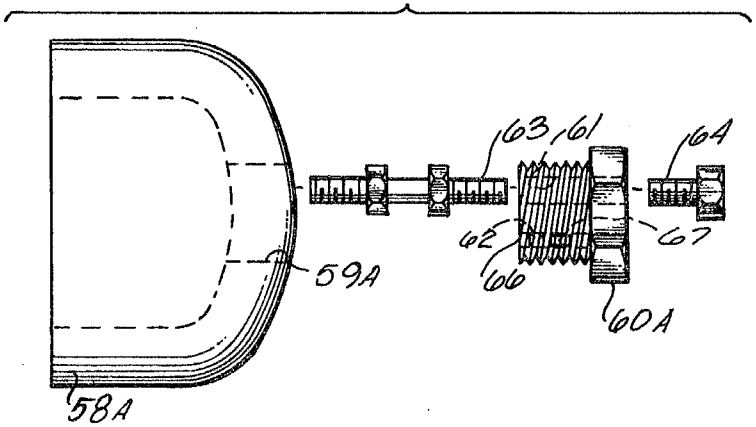
FIG. 6 is an exploded elevation view of a portion of another version of a container for confining a halogen source.

Another version of a gas bomb is shown in FIG. 6. In this version, pressure break diaphragm or rupture disc 67 responsive to high pressure in the container due to increase in the temperature of the halogen source is provided in the release hole 62A rather than a fusible plug. Another difference between the versions of FIGS. 5 and 6 is that both a fill hole 161A and a release hole 162A are provided through the same plug 160A in FIG. 6.

The size of the container 52 provided for releasing a halogen source is dependent upon the desired concentration of the halogen material in the effluent fluid from the retort.

For example, when the halogen source is a halocarbon, preferably sufficient halocarbon is confined in the container 52 that a concentration of halogen material of at least about 20 parts per million by volume appears in the off gas so that it can be detected by the monitoring means 38. A halocarbon can be confined as a liquid and released as a vapor to appear in the off gas.

The container and plug used for confining the halogen source must have sufficient strength to survive blasting to form the fragmented permeable mass when the container is placed in the retort prior to blasting.

In addition, the container must be able to withstand the high temperatures and corrosive environment present in the retort for at least a sufficient time to prevent premature release of the halogen source. Corrosion of the container can be caused by sulfurous compounds present in gases passing through a retort. When a halocarbon is used as the halocarbon source, the container must be able to resist the internal pressures developed in the container due to heating of the halocarbon prior to its release at the selected temperature. Also, internal corrosion can be a problem when using halocarbons because of the chlorine and fluorine resulting from thermal decomposition of the halocarbon. Therefore, the choice of container material can be critical. Suitable materials for forming a container include Monel nickel-copper alloy, Inconel nickel-chromium alloy, and carbon steel of sufficient thickness that it does not corrode through before release of the halogen source.

Techniques utilizing features of this invention are demonstrated by the following examples.

EXAMPLE 1

Figure 3:
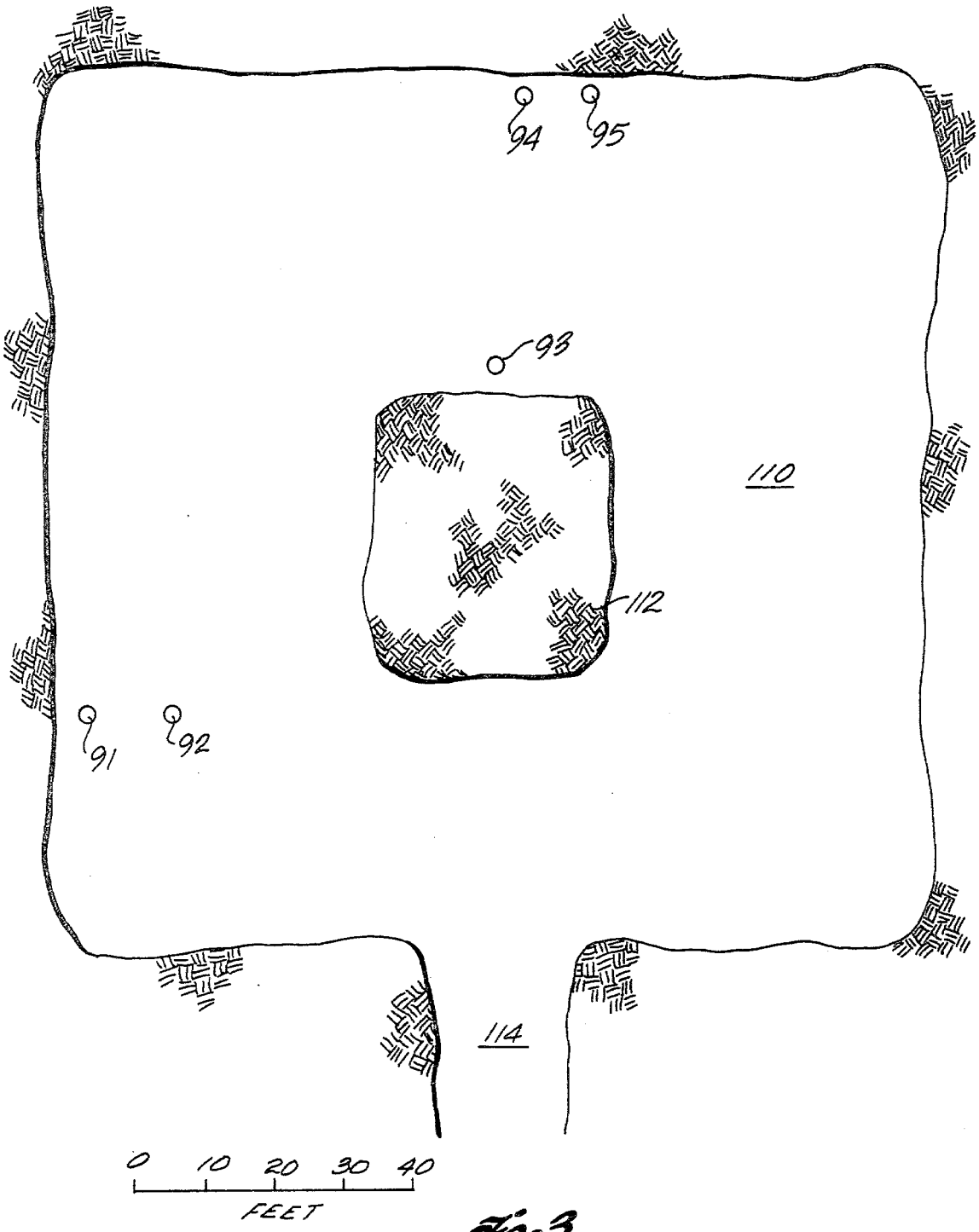
FIG. 3 is an overhead plan view of a work area for an in situ oil shale retort showing placement of a plurality of halogen sources in the retort for monitoring the locus of a processing zone in the retort.

FIG. 3 is an overhead plan view of a working level room 110 used in formation of an in situ oil shale retort in the south/southwest portion of the Piceance Creek structural basin in Colorado. Below the working level room is unfragmented formation which is to be expanded to form a fragmented mass of particles in the retort. The workroom is about 120 feet square, about the same dimensions as the fragmented mass in the retort. The fragmented mass to be formed extends downwardly into the formation for about 232 feet below the floor of the room 110. A central pillar 112 of unfragmented formation is left in place to support the roof of the working level room. A drift 114 is provided for access to the workroom.

The fragmented mass in the retort was doped with containers containing halocarbons as the halogen source. The containers, i.e., gas bombs, used for the halocarbons were prepared in accordance with the design shown in FIG. 5. Each container was formed from a six inch long piece of carbon steel pipe 54 having a nominal diameter three inches, with 0.6 inch wall thickness. Three inch end caps 58A and 58B were welded on the pipe. The filling mechanism was built into a one-inch NPT hex plug 60A located in the end of one of the caps 58A and the discharge mechanism was built into a one inch NPT hex plug. A threaded fill hole 61 in the plug 60A of the fill mechanism was provided for a $\frac{1}{4}$ inch check valve 63. The outer end of the fill hole was sealed with a $\frac{1}{4}$ inch NPT plug 64 after filling the cylinder with halocarbon.

A $\frac{1}{8}$ inch release hole 62 in the plug 60B of the release mechanism was threaded full length with a 10–32 thread for extra bonding surface to avoid premature extrusion of the fusible plug from the hole as the plug softens at elevated temperatures. The release hole 62 was filled with a cast-in-place fusible plug 66 of pure zinc. The length of the hex plug 60B and the zinc plug 66 was about $1\frac{1}{4}$ inches.

The 0.6-inch wall thickness and short cylinder length of this bomb provide a strong, compact container capable of surviving a blast for forming the cavity and fragmented permeable mass of the retort of FIG. 3. Because of the use of pure zinc metal plug, it is expected that halocarbons used in the container are released at about 787° F.

Three bombs containing Freon 13 ($CClF_3$), three bombs containing Freon 113 ($CCl_2FCClF_2$), and two bombs containing Freon 116 ($C_2F_6$) were provided.

The average empty weights of all bombs was about $18\frac{1}{2}$ pounds. The net weights of the three Freon 13 bombs were 1 lb 5 oz., 1 lb. 4 oz., and 1 lb. 0 oz. The net weights of the two Freon 116 bombs were 1 lb. 0 oz., and 0 lb. 11 oz. Each Freon 113 bomb was filled with 300 ml. (446 grams) of liquid Freon 113.

Assuming complete mixing of halocarbon in the gas bomb with the gases flowing through the retort and a superficial gas flow rate through the retort of about one standard cubic foot per minute per square foot of fragmented permeable mass being retorted, it was calculated that the off gas would have a Freon concentration from about 20 to about 100 parts per million by volume having a 5 second pulse with a 30 minute tail.

The monitoring means proposed for detecting Freon in the off gas was a Honeywell 1000 Hi-Speed gas chromatograph modified with a Valco valve for stripping hydrocarbons from gas samples and a Valco electron capture detector.

The placement of the gas bombs in the retort is shown in FIG. 3. Prior to blasting to form the retort, five bore holes 91, 92, 93, 94, 95 were formed by drilling downwardly from the floor of the working level room into the portion of the formation to be fragmented by blasting to form the retort.

A bomb containing Freon 113 was placed about $2\frac{1}{2}$ feet down into bore hole 91, which has a $4\frac{1}{2}$ inch diameter. Bore hole 92, which was $6\frac{1}{2}$ inches in diameter, contained two Freon 116 bombs. One bomb was placed 87 feet down in the hole 92 and the other bomb was placed 10 feet down. Stemming with formation particles was used between the bombs; that is, formation particles were poured into the bore hole for filling.

Bore hole 93 was $4\frac{1}{2}$ inches in diameter and contained one Freon 13 bomb. The bomb was placed one foot down in the bore hole 93 and was stemmed with formation particles.

Bore hole 94 was $6\frac{1}{4}$ inches in diameter and contained one Freon 13 bomb placed five feet down with formation particle stemming.

Bore hole 95 had a $6\frac{1}{4}$ inch diameter and three Freon 13 bombs were placed 174, 116 and 77 feet down the hole. Stemming with formation particles were used for the bottom bomb, sand stemming was used for the middle bomb, and no stemming to the top was used for the top bomb. After placement of the bombs, formation was explosively expanded to form an in situ oil shale retort containing a fragmented permeable mass of formation particles containing oil shale. Subsequently oil shale in the fragmented mass was retorted.

The Honeywell chromatograph was not modified in time for the retorting operation and thus the locus of the advancing retorting and combustion zones could not be determined.

The bomb depths presented above were measured with a measuring rope to the lower end of the bomb. The fusible plug was always oriented upwardly, and was about one foot higher than the depth indicated. However, this could be offset by dropping of a bomb during blasting. It is estimated that during blasting to form the cavity and expand formation particles to form the fragmented permeable mass, bombs dropped on an average of about two feet. Therefore, it is estimated that the contents of the bombs were released at about one foot lower than the depth the bomb was placed in the bore hole.

EXAMPLE 2

Figure 4:
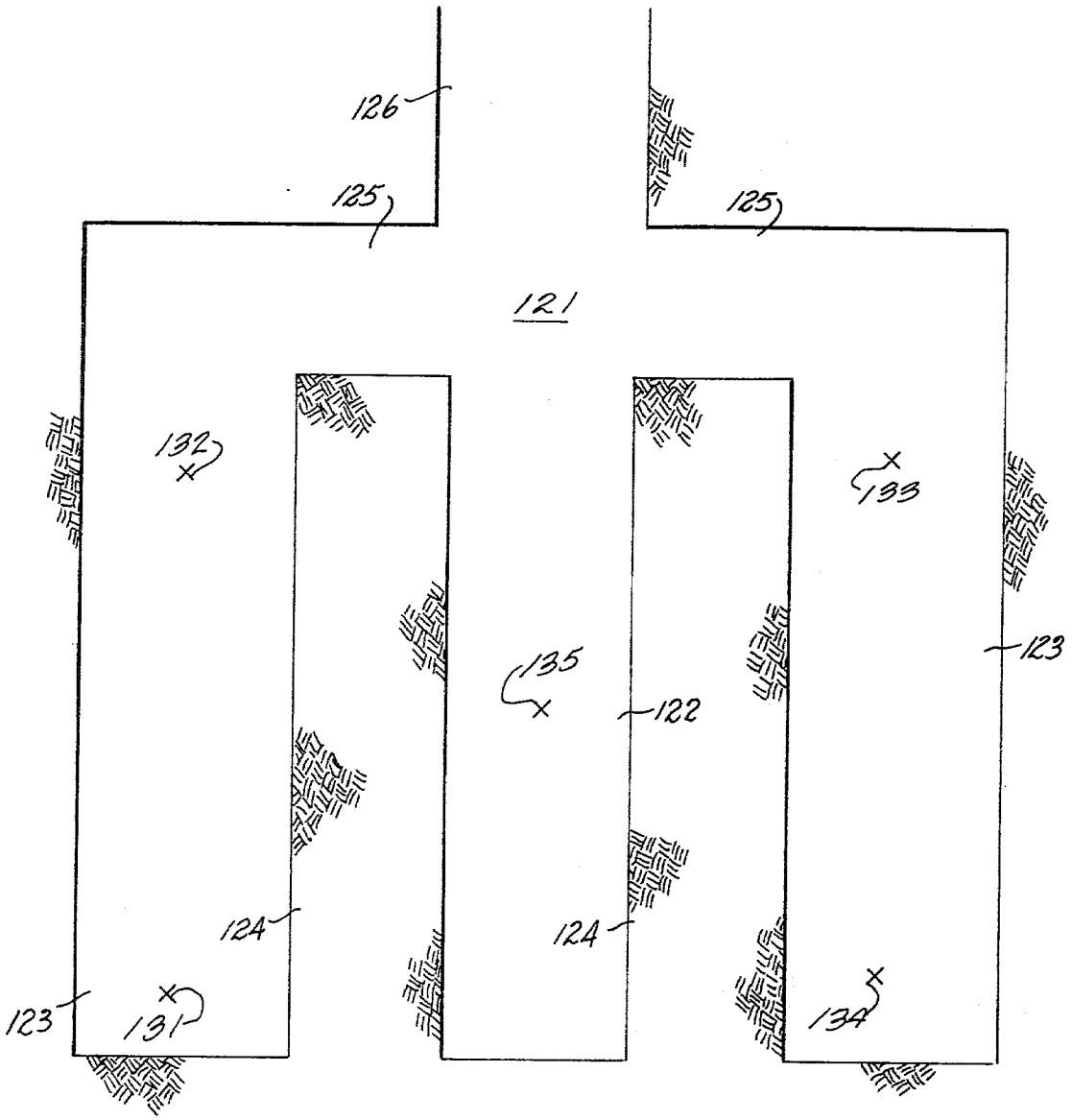
FIG. 4 is an overhead plan view of a work area for another retort showing placement of halogen sources for monitoring the locus of a processing zone advancing through the retort.

FIG. 4 shows an overhead plan view of a subterranean base of operation or room 121 on a working level used for forming an in situ oil shale retort. The base of operation has a central drift 122 and a side drift 123 on each side thereof. The two side drifts are similar to each other. Elongated roof supporting pillars 124 of intact formation separate the side drifts 123 from the central drift 122. Short cross cuts 125 interconnect the side drifts 123 and central drift 122 to form a generally E-shaped excavation. A branch drift 126 provides access to the base of operation from underground mining development workings (not shown) at the elevation of the base of operation.

Thirty gas bombs of the same type described in Example 1 were loaded with halogen source. The loadings of each bomb are presented in Table 1. It was attempted to load the bombs to about 70 percent of full to allow ullage for vaporization and expansion of the halogen source in the bombs prior to release.

Five bore holes 131–135 were drilled downwardly from the floor of the base of operation 124. The location of each bore hole is marked by an "X" in FIG. 4. The depths of bore holes 131–135 were 220 feet, 206 feet, 212 feet, 213 feet and 209 feet, respectively. The bore hole provided for each bomb and the depth of the bomb in its respective bore hole is presented in Table 2. The depths presented in Table 2 are from the floor of the base of operation 124. Because of the presence of a 40 feet thick horizontal sill pillar below the base of operation, the bombs are actually placed 40 feet less into the fragmented mass than the depths recited in Table 2. For example, bomb 19 was 60 feet down, measured from the floor of the base of operation, but because of the 40 feet thick sill pillar, bomb 19 was only 20 feet below the top of the fragmented mass.

A fragmented permeable mass (not shown) was formed by explosively expanding formation below the room. The fragmented mass was square with a side of about 118 feet and was about 165 to 200 feet deep with a sloping bottom boundary. A horizontal sill pillar of unfragmented formation was left between the floor of the base of operation 124 and the top of the fragmented permeable mass.

As with Example 1, it was expected that the bombs dropped about two feet during the blasting to form the retort, but since the bombs were placed so the zinc plug was oriented upwardly, the gas released by the bombs is about one foot lower than the depth value presented in Table 2. For example, bomb 19 releases Freon 11 at a depth below the floor of the base of operation of about 61 feet rather than 60 feet.

The same detection and monitoring means proposed to be used for Example 1 were provided for the retort of Example 2. No halogen material was detected. It was used only intermittently for detection of halogen material. It was concluded that to monitor the presence of halogen material in off gas from a retort, a monitor devoted full time to halogen material detection is required.

TABLE 1

| | GAS BOMB LOADING | | | | |
|---|---|---|---|---|---|
| Bomb Number | $SF_6$ (pounds) | Freon 13 (pounds) | Freon 12 (pounds) | Freon 11 (milli-liters) | Freon 113 (milli-liters) |
| 1 | 2.4375 | | | | |
| 2 | 1.7938 | | | | |
| 3 | 2.21817 | | | | |
| 4 | 1.6406 | | | | |
| 5 | 2.3281 | | | | |
| 6 | 1.4843 | | | | |
| 7 | | 1.6875 | | | |
| 8 | | 1.4219 | | | |
| 9 | | 1.3282 | | | |
| 10 | | 1.5469 | | | |
| 11 | | 1.0625 | | | |
| 12 | | 1.7657 | | | |
| 13 | | | 1.2813 | | |
| 14 | | | 1.5312 | | |
| 15 | | | 1.2344 | | |
| 16 | | | 1.4375 | | |
| 17 | | | 1.4219 | | |
| 18 | | | 1.5313 | | |
| 19–24 | | | | 454 each | |
| 25–30 | | | | | 454 each |

TABLE 2

| | GAS BOMB LOCATION DEPTH (FEET) INTO BORE HOLE (measured from the floor of the base of operation) | | | | |
|---|---|---|---|---|---|
| Bomb Number | Hole 131 | Hole 132 | Hole 133 | Hole 134 | Hole 135 |
| 1 | | | | | 60 |
| 2 | | | | | 150 |
| 3 | | | | | 120 |
| 4 | | | | | 180 |
| 5 | | | | | 90 |
| 6 | | | | | 209 |
| 7 | 90 | | | | |
| 8 | 150 | | | | |
| 9 | 164 | | | | |
| 10 | 120 | | | | |
| 11 | 210 | | | | |
| 12 | 52 | | | | |
| 13 | | 180 | | | |
| 14 | | 90 | | | |
| 15 | | 205 | | | |
| 16 | | 120 | | | |
| 17 | | 150 | | | |
| 18 | | 60 | | | |
| 19 | | | 60 | | |
| 20 | | | 90 | | |
| 21 | | | 120 | | |
| 22 | | | 150 | | |
| 23 | | | 180 | | |
| 24 | | | 210 | | |
| 25 | | | | 60 | |
| 26 | | | | 90 | |
| 27 | | | | 120 | |
| 28 | | | | 150 | |
| 29 | | | | 180 | |
| 30 | | | | 210 | |

Monitoring the locus of the processing zone advancing through the fragmented permeable mass 16 in the retort 10 has significant advantages. For example, steps can be taken to maintain the combustion zone flat and uniformly perpendicular to the direction of its advancement to minimize oxidation and excessive cracking of hydrocarbons produced in the retorting zone. In addition, the rate of introduction and composition of the retort inlet mixture can be controlled to maintain the temperature in the combustion zone sufficiently low to avoid formation of excessive amounts of carbon dioxide and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the retort inlet mixture.

Although this invention has been described in considerable detail with reference to certain versions thereof, other versions of this invention can be practiced. For example, although the invention has been described in terms of a single in situ oil shale retort containing both a combustion processing zone and a retorting processing zone, it is possible to practice this invention with a retort containing only one processing zone, either a combustion or retorting zone. In addition, although FIG. 1 shows a retort where the combustion and retorting zones are advancing downwardly through the retort, this invention is also useful for retorts where the combustion and retorting zones are advancing upwardly or transverse to the vertical.

Also, even though the drawings show retorts having a plurality of halogen sources, it can be useful to have only one halogen source. Furthermore, although FIG. 1 shows the monitoring means 38 and 40 below ground in the horizontal drift 20 from the bottom of the retort 12, monitoring means can be provided at any location such as above ground for operating and maintenance convenience.

Because of the variations such as these, the spirit and scope of the appended claims should not be limited to the description of the preferred versions contained herein.

A method for determining the locus of a processing zone within an in situ retort using indicators, including indicators such as halogen-containing compounds and radio-nuclides, and apparatus for containing such indicators are disclosed in co-pending U.S. patent applications: Ser. No. 801,631, filed on May 31, 1977, by Robert S. Burton III and Carl Chambers, now U.S. Pat. No. 4,149,592 entitled CONTAINERS FOR INDICATORS; Ser. No. 798,376, filed on May 9, 1977 by Robert S. Burton III, entitled USE OF CONTAINERS FOR DOPANTS TO DETERMINE THE LOCUS OF A PROCESSING ZONE IN A RETORT and now abandoned; and Ser. No. 869,668, filed on Jan. 16, 1978, by Robert S. Burton III, now U.S. Pat. No. 4,148,529 entitled DOPING A RETORT TO DETERMINE THE LOCUS OF A PROCESSING ZONE; and all assigned to the assignee of this invention.

Although the method herein, claiming a method for determining a locus of a processing zone using a halogen source as an indicator, is disclosed in the co-pending applications such co-pending applications are not prior art references as the method herein was developed prior to the filing dates of the applications.

What is claimed is:

1. A method for determining the locus of a processing zone advancing through a fragmented permeable mass of formation particles in an in situ oil shale retort in a subterranean formation containing oil shale, the retort having an effluent gas produced therein and withdrawn therefrom, the method comprising the steps of:

placing at a selected location within the boundaries of a retort at least one halogen source for providing halogen material, at least a portion of such halogen material being in the vapor phase at the temperature and pressure of the effluent gas, wherein such halogen source provides halogen material at a predetermined temperature greater than ambient;

advancing a processing zone through the fragmented mass for producing such an effluent gas which is withdrawn from the retort and for providing halogen material from such halogen source at a predetermined temperature; and monitoring effluent gas from the retort for presence of such halogen material.

2. A method as claimed in claim 1 wherein before such halogen material is provided, the effluent gas contains less than about 20 ppm halogen material by volume.

3. A method as claimed in claim 1 wherein a plurality of halogen sources are placed at selected locations within the boundaries of a retort to be formed and wherein each halogen source provides a distinct halogen material different from the halogen material provided by the adjacent halogen sources.

4. A method as claimed in claim 3 wherein at least three halogen sources spaced apart from each other are in a plane substantially normal to the direction of advancement of the processing zone.

5. A method as claimed in claim 4 wherein at least three halogen sources spaced apart from each other are in each of a plurality of planes spaced apart from each other along the direction of advancement of a processing zone.

6. A method as claimed in claim 5 wherein the halogen sources within a given plane provide the same halogen material.

7. A method as claimed in claim 6 wherein the halogen sources in adjacent planes provide different halogen material.

8. A method as claimed in claim 5 wherein each halogen source provides a different halogen material than any adjacent halogen source.

9. A method as claimed in claims 3, 4 or 8 wherein the different halogen materials are provided by varying at least one measurable halogen characteristic selected from the selection, concentration and combination of halogen sources, which halogen sources are selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons; hydrogen halides; molecular halogens; halosilanes and mixtures thereof.

10. A method as claimed in claims 3, 4 or 8 wherein the different halogen materials provided by the halogen sources are provided by varying the ratio of halogen materials within halogen sources.

11. A method as claimed in claim 1 wherein the halogen source is selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons; hydrogen halides; molecular halogens; halosilanes and mixtures thereof.

12. A method for determining the locus of at least one processing zone advancing through a fragmented permeable mass of formation particles containing oil shale in an in situ oil shale retort in a subterranean formation, the fragmented mass having a combustion processing zone advancing therethrough and a retorting processing zone advancing therethrough on the advancing side of the combustion processing zone, and wherein an effluent fluid consisting of an off gas portion and a liquid portion is withdrawn from said fragmented mass on the advancing side of the retorting processing zone, the method comprising the steps of:

placing at least one halogen source for providing halogen material at a selected location within the fragmented mass in the retort, wherein at least a portion of the halogen material provided by the halogen source is in the effluent fluid at the temperature and pressure of the effluent fluid, and wherein such a halogen source provides halogen material at a predetermined temperature greater than ambient; and monitoring the effluent fluid withdrawn from the retort for presence of such halogen material.

13. A method as claimed in claim 12 wherein at least a portion of the halogen material provided by the halogen source is in the gaseous phase at the temperature and pressure of the off gas and such off gas withdrawn from the retort is monitored for the presence of such halogen material.

14. A method as claimed in claim 12 wherein at least a portion of the halogen material provided by the halogen source is in the liquid phase at the temperature and pressure of the liquid portion in the effluent fluid and such liquid portion of the effluent fluid withdrawn from the retort is monitored for the presence of such halogen material.

15. A method as claimed in claim 12 wherein a plurality of halogen sources comprising at least one first and at least one second halogen source are placed at selected locations in the in situ retort, wherein such a first halogen source provides a first halogen material at a temperature characteristic of the combustion processing zone, and such a second halogen source provides a second halogen material different from the first halogen material at a temperature characteristic of the retorting processing zone and the effluent fluid is monitored for both first and second halogen materials.

16. A method as claimed in claim 15 wherein at least three first halocarbon sources spaced apart from each other are in a plane substantially normal to the direction of advancement of the combustion processing zone.

17. A method as claimed in claim 16 wherein at least three halogen sources spaced apart from each other are in each of a plurality of planes spaced apart from each other along the direction of advancement of the combustion processing zone.

18. A method as claimed in claim 17 wherein the first halogen sources within a given plane provide the same first halogen material.

19. A method as claimed in claim 18 wherein the first halogen sources in adjacent planes provide different first halogen material.

20. A method as claimed in claim 17 wherein each first halogen source in adjacent planes provides a different halogen material than any adjacent halogen source.

21. A method as claimed in claim 15 wherein at least three second halogen sources spaced apart from each other are in a plane substantially normal to the direction of advancement of the retorting processing zone.

22. A method as claimed in claim 21 wherein at least three second halogen sources are spaced apart from each other in each of a plurality of planes spaced apart from each other along the direction of advancement of the retorting processing zone.

23. A method as claimed in claim 22 wherein each second halogen source in adjacent planes provides a different halogen material than any adjacent halogen source.

24. A method as claimed in claim 21 wherein the second halogen sources within a given plane provide the same second halogen material.

25. A method as claimed in claim 24 wherein the second halogen sources in adjacent planes provide different second halogen material.

26. A method as claimed in claims 15, 19, 20, 25 or 23 wherein the different halogen material is provided by varying at least one measurable halogen characteristic selected from the selection, concentration and combination of halogen sources, which halogen sources are selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons; hydrogen halides; molecular halogens; halosilanes and mixtures thereof.

27. A method as claimed in any of claims 15, 19, 20, 25 or 23 wherein the different halogen materials provided by the halogen sources are provided by varying the ratio of one halogen to another halogen within halogen sources.

28. A method as claimed in claim 12 wherein the halogen source is selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons, hydrogen halides, molecular halogens, halosilanes, and mixtures thereof.

29. In a method for determining the locus of a processing zone advancing through a fragmented permeable mass of formation particles in an in situ oil shale retort in a subterranean formation containing oil shale, the retort having an effluent fluid produced therein and withdrawn therefrom, by the steps of placing at a selected location within the boundaries of the retort indicator means for providing an indicator at a predetermined temperature greater than ambient, advancing the processing zone through the fragmented mass for producing such an effluent fluid and monitoring the effluent fluid for presence of such an indicator, the improvement comprising the step of selecting as an indicator a halogen material selected from the group consisting of halogenated and polyhalogenated, straight-chain and branched, saturated and unsaturated aliphatic hydrocarbons having from 1 to about 8 carbon atoms; halogenated and polyhalogenated aromatic hydrocarbons; hydrogen halides; molecular halogens; halosilanes and mixtures thereof.

30. A method as claimed in claim 29 further comprising providing different indicators at different locations within the retort by placing at selected locations within the boundaries of the retort a plurality of indicator means for providing an indicator and varying the ratio, selection and concentration of halogen sources of said indicator means.

31. A method as claimed in claim 29 further comprising providing a different indicator from each of a plurality of such indicator means within the retort by placing within each indicator means at least two halogen sources and varying the ratio of such halogen sources.

* * * * *